US007753374B2

(12) United States Patent
Ho

(10) Patent No.: US 7,753,374 B2
(45) Date of Patent: Jul. 13, 2010

(54) AUTOMATIC SHUFFLING MACHINE

(75) Inventor: Cai-Shiang Ho, Taipei (TW)

(73) Assignee: Taiwan Fulgent Enterprise Co., Ltd., Taipei (TW)

( * ) Notice: Subject to any disclaimer, the term of this patent is extended or adjusted under 35 U.S.C. 154(b) by 259 days.

(21) Appl. No.: 12/107,851

(22) Filed: Apr. 23, 2008

(65) Prior Publication Data

US 2009/0267296 A1 Oct. 29, 2009

(51) Int. Cl.
*A63F 1/12* (2006.01)

(52) U.S. Cl. ..... 273/149 R; 462/22

(58) Field of Classification Search ..... 273/149 R, 273/149 P; 463/22

See application file for complete search history.

(56) References Cited

U.S. PATENT DOCUMENTS 4,586,712 A * 5/1986 Lorber et al. ..... 273/149 R
4,659,082 A * 4/1987 Greenberg ..... 273/149 R
5,989,122 A * 11/1999 Roblejo ..... 463/22
6,659,460 B2 * 12/2003 Blaha et al. ..... 273/149 R
7,448,626 B2 * 11/2008 Fleckenstein ..... 273/149 R
7,500,672 B2 * 3/2009 Ho ..... 273/149 R
7,584,963 B2 * 9/2009 Krenn et al. ..... 273/149 R

* cited by examiner

*Primary Examiner*—Benjamin H Layno
(74) *Attorney, Agent, or Firm*—Alan Kamrath; Kamrath & Associates PA

(57) ABSTRACT

An automatic shuffling machine has a shuffling wheel and a card input mounted adjacent to the shuffling wheel for conveying and inserting cards into slots formed in the shuffling wheel. An insertion panel is mounted securely between the card input and the shuffling wheel, may be a curved shape corresponding to the shuffling wheel and has a tangent surface opposite to the shuffling wheel and an abutting portion disposed between an inlet passage of the card input and one corresponding card slot of the shuffling wheel. Thus, by controlling the rotation of the shuffling wheel, the automatic shuffling machine input the cards in a simple and efficient manner.

4 Claims, 5 Drawing Sheets

AUTOMATIC SHUFFLING MACHINE

BACKGROUND OF THE INVENTION

1. Field of the Invention

The present invention relates to a shuffling machine, and more particularly to an automatic shuffling machine with a simple structure that is loaded rapidly and easily.

2. Description of Related Art

Generally, a card shuffler comprises a drivable shuffling storage means, an input apparatus and an optional output storage means. The shuffling storage means has multiple compartments to receive and hold cards and is associated with the input apparatus for inserting cards into the compartments. The output storage means is separated from the shuffling storage means for storing shuffled cards. With movement of the shuffling storage means and the input apparatus being controlled by an electronic control system, the cards being discharged from the shuffling wheel will be in a random sequence and may be stored in the output storage means. Therefore, the cards are completely shuffled.

Accordingly, the input apparatus has a conveyor that has multiple active rollers arranged adjacent to each other along the input apparatus. Each active roller has at least two rollers driven by a drive system. When a deck of cards is put into the input apparatus, the deck of card is drawn into and conveyed along an inlet passage of the input apparatus by the conveyor one by one, and inserted into the compartments of the shuffling storage means.

The conveyor conveys and inserts the cards into the compartments of the shuffling storage means, however, to ensure cards are placed in the compartments, the card shuffler further has a lever. The lever is mounted in the input apparatus adjacent to the shuffling storage means and is connected to and is rotated by a control drive system. Being controlled by the control drive system, the lever may fully push a card conveyed toward and partially inserted into the compartment, thus the card is completely pushed into the shuffling wheel.

However, the lever, complicates input apparatus procedure raising time required for adding decks as well as manufacturing costs of the card shuffler.

To overcome the shortcomings, the present invention provides an automatic shuffling machine to obviate or mitigate the aforementioned problems.

SUMMARY OF THE INVENTION

The main objective of the present invention is to provide an automatic shuffling machine with a simple structure that is loaded rapidly and easily.

To achieve the objective, the automatic shuffling machine comprises a card input, a shuffling wheel and an insertion panel.

The card input allows a deck of cards to put in and has a conveyor. The conveyor has multiple active rollers arranged adjacent to each other in the card input. Each active roller has at least two rollers driven by a drive system. The cards of the card stack may be drawn into and conveyed along an input gap of the card input by the conveyor one by one.

The shuffling wheel has a base, a shuffling wheel and a discharging rod. The base is set stably on a planar surface and is attached with a controller and a rotary driver. The rotary driver is controlled by the controller and drives the shuffling wheel to rotate in a determined manner. The shuffling wheel is mounted rotatably on the base and has multiple card slots formed radially around which, each of the card slots selectively corresponds to the input gap and stores at least one card being conveyed by the conveyor.

The insertion panel is mounted securely between the card input and the shuffling wheel, may be a curved shape corresponding with the shuffling wheel and has a tangent surface opposite to the shuffling wheel and an abutting portion disposed between the inlet passage of the card input and one corresponding card slot of the shuffling wheel.

When a card is conveyed by the conveyor and stored in one card slot, the shuffling wheel is driven to rotate and a protruding end of the card abuts the abutting portion of the insertion panel to make the card be bent and received between the tangent surface and the card slot. Afterward, the shuffling wheel rotates in a reverse direction for insertion of another card. Meanwhile the bent card is slid along and guided by the tangent surface to return to a straight status and generate a force due to resilience to spring completely into the card slot.

Accordingly, the automatic shuffling machine inputs the cards via simply arrangement of the insertion panel and not only simplify a structure of which and reduces a cost of fabrication, but also completes a card input procedure in an efficient manner.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
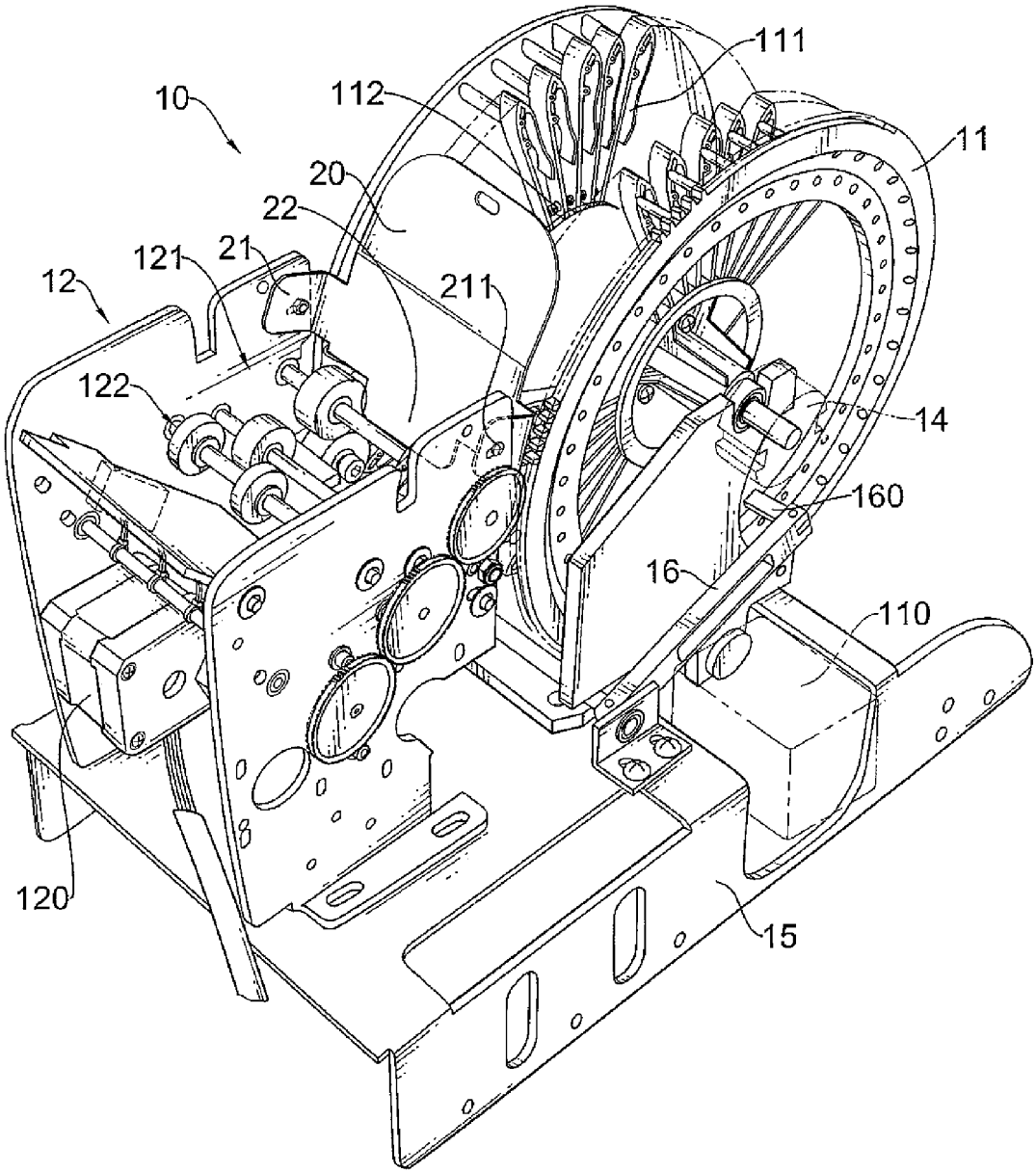
FIG. 1 is a perspective view of an automatic shuffling machine in accordance with the present invention.
Figure 2:
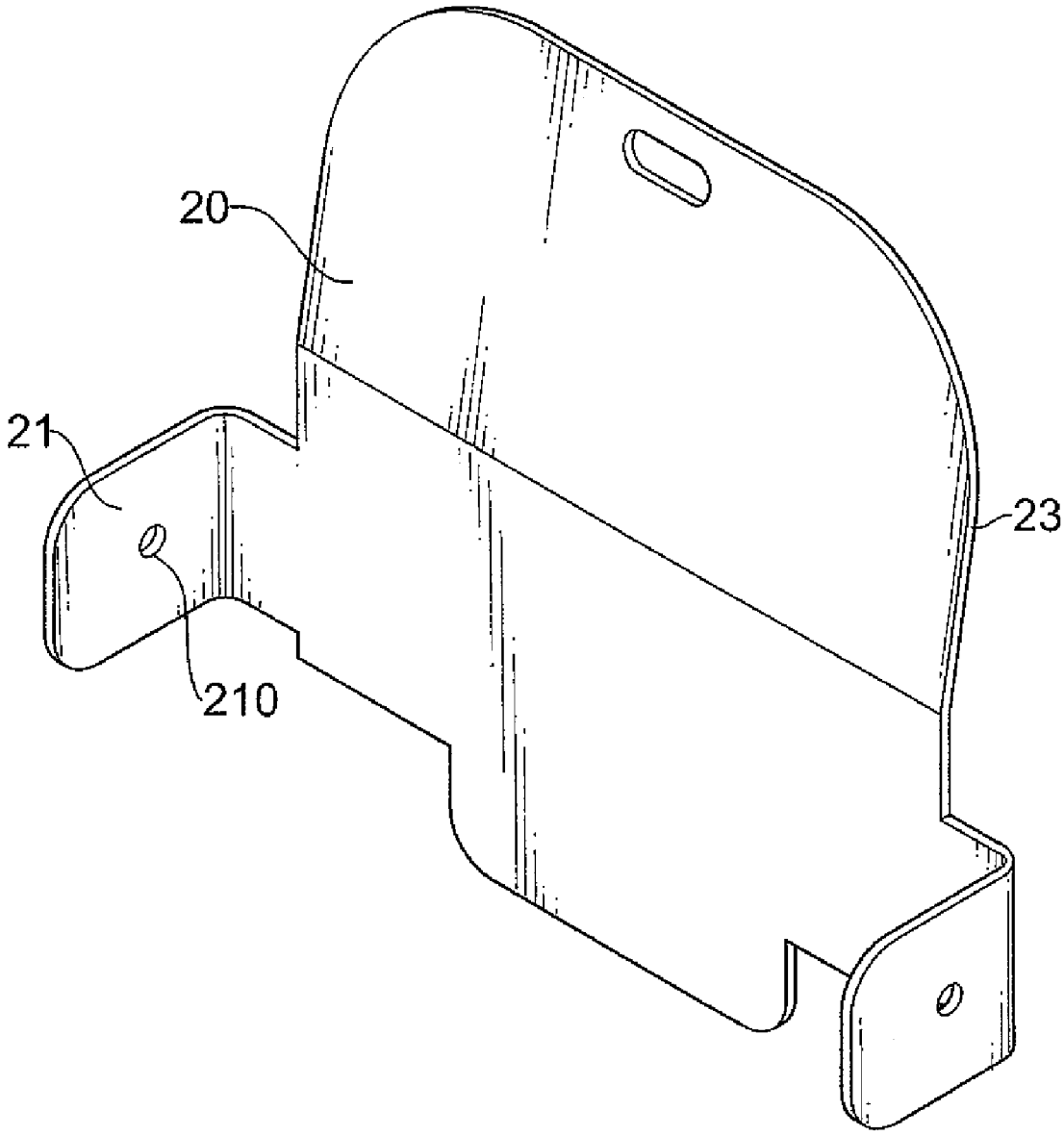
FIG. 2 is perspective view of the insertion panel of the automatic shuffling machine in FIG. 1.
Figure 4:
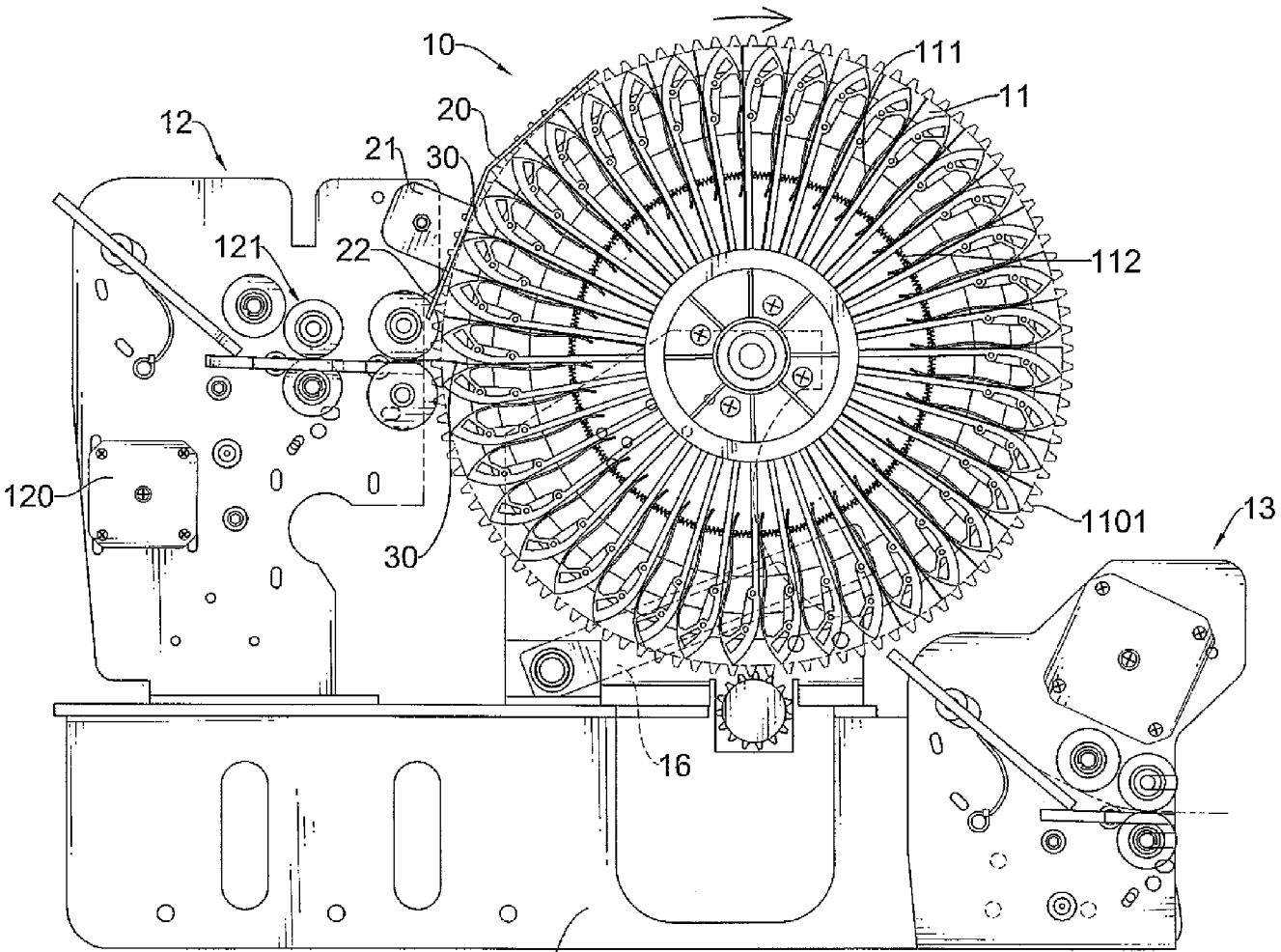
FIG. 4 is an operational side view of the automatic shuffling machine in FIG. 1.

With reference to FIGS. 1, 2 and 4, the automatic shuffling machine in accordance with the present invention comprises a base (10), a card input (12), at least one insertion panel (20) and an optional card output (13).

The base (10) has a rotary driver (110), a shuffling wheel (11) and two discharging rods (16).

The base (10) can be placed on a planar surface, has a rotary driver (110) and a controller (14). The rotary driver (110) is mounted on the base (10) and has a drive gear (1100) rotatably mounted thereon.

The controller (14) is mounted securely on the base (10), controls the rotary driver (110) to drive the drive gear (1100) to selectively rotate by a random number of degrees in an opposite direction.

Figure 5:
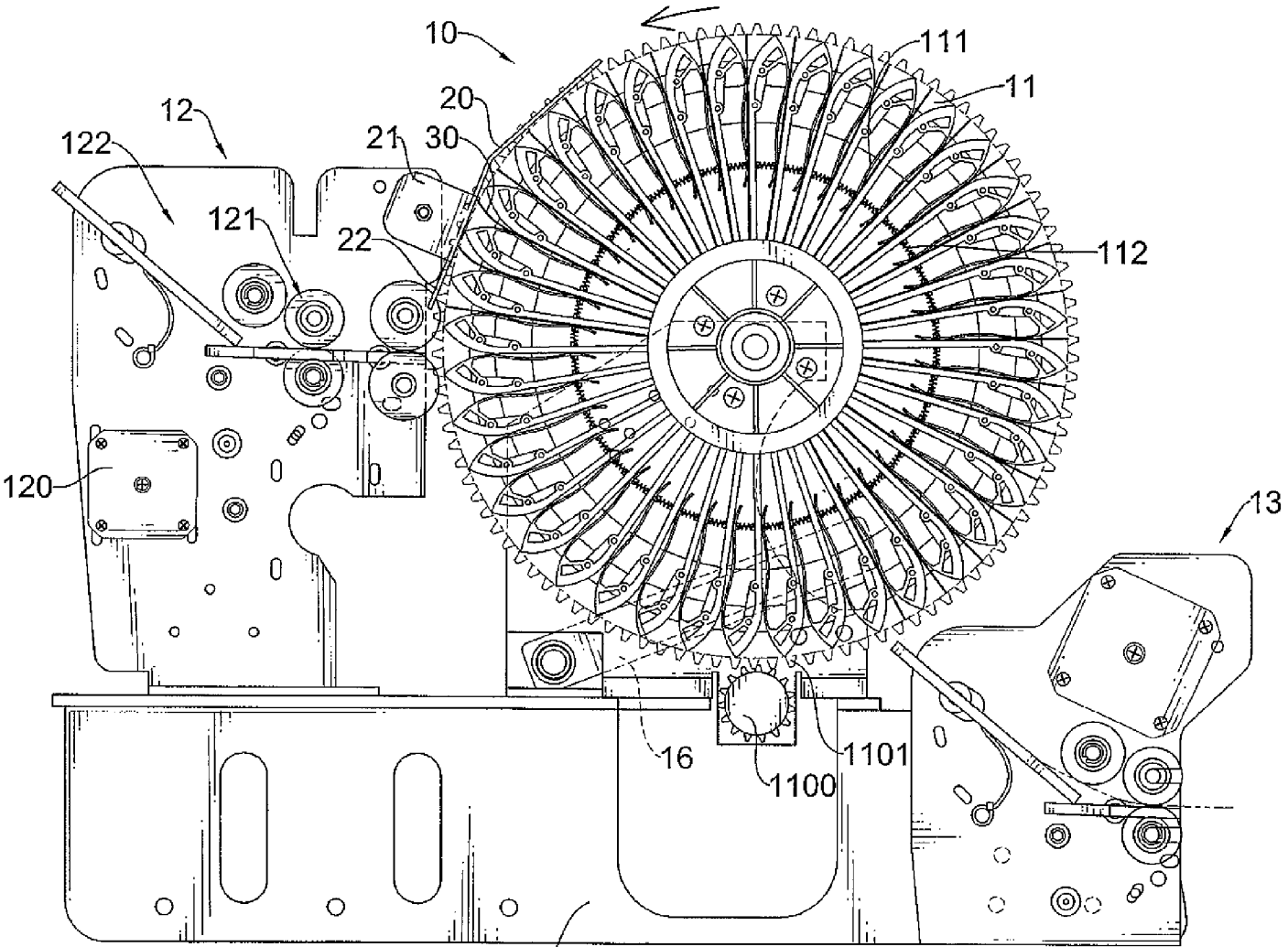
FIG. 5 is another operational side view of the automatic shuffling machine in FIG. 1.

With further reference to FIG. 5, the shuffling wheel (11) is mounted rotatably on the base (10), is driven by the rotary driver (110) and has multiple teeth (1101), multiple card slots and multiple retainers (111). The teeth (1101) are formed annularly around the shuffling wheel (11) and engage the drive gear (1100) of the rotary driver (110) of the base (10) and allow the shuffling wheel (11) to be controlled by the controller (14) to rotate by a random angle. The card slots are formed radially around the shuffling wheel (11), and store at least one card (30). The retainers (111) are mounted respectively in the card slots and respectively comprise resilient elements (112) to stably hold the cards (30) securely in the card slots.

The discharging rods (16) are mounted pivotally on the base (10), are mounted adjacent to the shuffling wheel (11) and can be driven to pivot by a rod driver. Each discharging rod (16) has an arm (160). The arm (160) protrudes transversely from the discharging rod (16) and selectively aligns with one of the card slots to push the card (30) out of the card slot.

The card input (12) is mounted adjacent to the shuffling wheel (11) and has a conveyor (121), a separator (122) and a drive system (120).

The conveyor (121) is mounted in the card input and has at least one active roller and at least one optional passive guide. The active rollers are mounted in pairs in the card input (12) and have an input gap formed therebetween. The input gap selectively aligns with the card slots of the shuffling wheel (11) to force a card (30) therethrough. The passive guide aligns with the input gap between the pairs of active rollers and may be passive rollers or a passive panel. When the passive guide is implemented as passive rollers, the passive rollers may be mounted in pairs and have a translation gap formed therebetween and aligning with the input gap of the active rollers. When the passive guide is implemented as a passive panel, the passive panel has an upper surface, aligning with and the input gap of the active rollers wherein active rollers mounted under the passive panel are formed and protrude therethrough.

The separator (122) is mounted in the card input (12) and has a driven roller and a resilient element. The driven roller is rotatably mounted adjacent to the conveyor (121) and may have a frictional surface formed around which. The resilient element is mounted adjacent to the driven roller, presses against the driven roller and allows a deck of cards to be mounted thereon and pressed against the driven roller.

The drive system (120) is mounted in the card input (12), connects to and drives each active roller and driven roller to rotate and may comprise multiple gear wheels and a drive motor.

Figure 3:
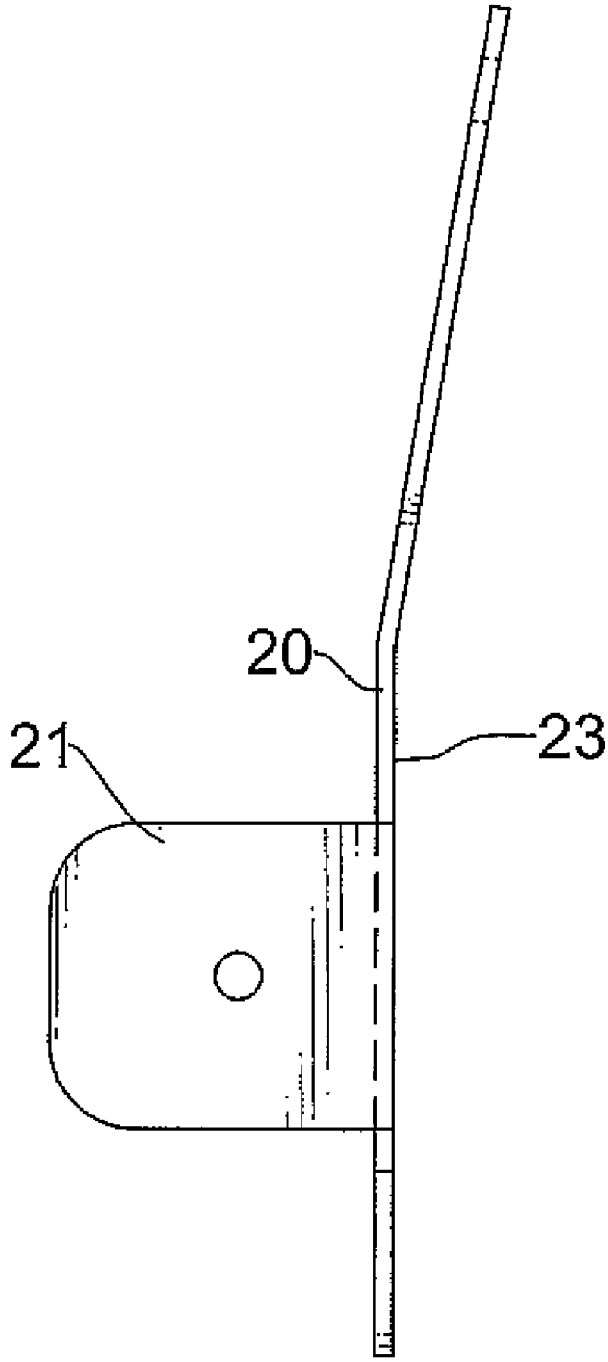
FIG. 3 is a side view of the insertion panel of the automatic shuffling machine in FIG. 2.

With further reference to FIG. 3, each insertion panel (20) is securely mounted adjacent to the card input (12) and the shuffling wheel (11), may be curved and has at least one tangent surface (23), at least one mounting tab (21) and multiple fasteners. Each tangent surface (23) is formed on the insertion panel (20), adjacent to and protrudes at a tangent from the shuffling wheel (11) and has two ends. The ends of the tangent surface (23) are separated by an insertion gap from the shuffling wheel (11). The fasteners are mounted respectively through the mounting tabs (21) and securely in the card input (12) to fasten the insertion panel (20) on the card input (12).

The card output (13) is structurally similar to the card input (12) and receives and dispenses the cards (30) discharged from the card slots of the shuffling wheel (11).

When a deck of cards (30) mounted in the separator (122), the cards are sequentially removed, conveyed by the conveyor (121) and each card having an outer end is pressed into one card slot of the shuffling wheel (11) that in turn is driven to rotate. When the shuffling wheel (11) rotates, should the outer end of the card (30) protrude out of the card slot, the tangent surface (23) of the insertion panel (20) make the card bend. Afterward, the shuffling wheel (11) rotates reversely for insertion of one another card (30), meanwhile the bent card (30) returns to a straight status and generates a force due to its resilience completely inserts into the card slot.

Accordingly, the automatic shuffling machine inputs the cards (30) due to simple arrangement of the insertion panel (20), simplified structure thereby reducing manufacturing costs as well as being faster to allow more cards to be shuffled.

Even though numerous characteristics and advantages of the present invention have been set forth in the foregoing description together with details of the structure and function of the invention, the disclosure is illustrative only. Changes may be made in detail especially in matters of shape, size and arrangement of parts within the principles of the invention to the full extent indicated by the broad general meaning of the terms in which the appended claims are expressed.

What is claimed is:

1. An automatic shuffling machine comprising a base having a rotary driver being mounted on the base and having a drive gear rotatably mounted thereon; and a controller being mounted securely on the base and controlling the rotary driver; and a shuffling wheel being mounted rotatably on the stage, being driven by the rotary driver to selectively rotate a random number of degrees and having multiple card slots being formed radially around the shuffling wheel;

a card input being mounted adjacent to the shuffling wheel and having a conveyor being mounted in the card input and having at multiple active rollers being mounted in pairs in the card input and having an input gap formed therebetween that selectively aligns with the card slots of the shuffling wheel;

a separator being mounted in the card input and having a driven roller being rotatably mounted adjacent to the conveyor and having a frictional surface formed around which; and a resilient element being mounted adjacent to the driven roller and selectively pressing against the driven roller; and a drive system being mounted in the card input and connecting to and driving each active roller and driven roller to rotate; and at least one insertion panel being securely mounted adjacent to the card input and the shuffling wheel and having at least one tangent surface being formed on the insertion panel, adjacent to and protruding at a tangent from the shuffling wheel.

2. The automatic shuffling machine as claimed in claim 1, wherein the insertion panel further has two mounting tabs protruding perpendicularly from the sides of the insertion panel;

two fasteners mounted respectively through the mounting tabs and being mounted securely in the card input to fasten the insertion panel on the card input.

3. The automatic shuffling machine as claimed in claim 1, wherein the rotary driver of the shuffling wheel further has a drive gear being mounted rotatably on the base; and the shuffling wheel further has multiple teeth being formed around the shuffling wheel and engaging the drive gear of the rotary driver of the base.

4. The automatic shuffling machine as claimed in claim 1, wherein the shuffling wheel further has multiple retainers being mounted respectively in the card slots, and each retainer is pushed by a resilient element.

* * * * *